US009395052B1

(12) United States Patent
Shew

(10) Patent No.: US 9,395,052 B1
(45) Date of Patent: Jul. 19, 2016

(54) MODULAR LIGHTING ASSEMBLY

(71) Applicant: Larry N. Shew, Highland, MI (US)

(72) Inventor: Larry N. Shew, Highland, MI (US)

( * ) Notice: Subject to any disclaimer, the term of this patent is extended or adjusted under 35 U.S.C. 154(b) by 91 days.

(21) Appl. No.: 14/079,635

(22) Filed: Nov. 13, 2013

Related U.S. Application Data

(60) Provisional application No. 61/725,703, filed on Nov. 13, 2012.

(51) Int. Cl.
*F21K 99/00* (2016.01)

(52) U.S. Cl.
CPC ..... *F21K 9/175* (2013.01)

(58) Field of Classification Search
CPC ..... F21S 4/003; F21V 15/01
USPC ..... 362/219, 220, 647, 652–659
See application file for complete search history.

(56) References Cited

U.S. PATENT DOCUMENTS 6,341,875 B1 * 1/2002 Chu ..... 362/249.06
7,401,946 B2 * 7/2008 Laukhuf ..... H01R 31/06 362/219
7,878,678 B1 * 2/2011 Stamatatos et al. ..... 362/184
8,070,314 B2 * 12/2011 St. Ives ..... F21V 15/015 362/217.13
8,206,004 B2 * 6/2012 Serak ..... H01R 31/02 362/217.1
2001/0036070 A1 * 11/2001 Compagnucci ..... A47B 77/00 362/127
2002/0075675 A1 * 6/2002 Yaphe ..... F21S 2/00 362/225
2003/0063463 A1 * 4/2003 Sloan et al. ..... 362/238
2006/0215405 A1 * 9/2006 Jung et al. ..... 362/249
2008/0094828 A1 * 4/2008 Shao ..... F21K 9/00 362/219
2008/0094848 A1 * 4/2008 Inagaki et al. ..... 362/362
2010/0118532 A1 * 5/2010 Liang et al. ..... 362/235
2010/0124053 A1 * 5/2010 Wu ..... F21S 2/00 362/219

* cited by examiner

*Primary Examiner* — Laura Tso
(74) *Attorney, Agent, or Firm* — L.C. Begin & Associates, PLLC.

(57) ABSTRACT

A light assembly contains a first component containing at least one light emitting diode electronically communicating with a second component containing at least one light emitting diode. The first and second components may each respectively contain a male connector and a female connector. The first and second components may be configured to be in linear or non-linear orientation to each other, or in orthogonal orientation with each other. Additional components each having at least one light emitting diode may be connected to said first and second components by using at least one conductive junction member to physically and electronically connect said first, second, and additional components.

13 Claims, 13 Drawing Sheets

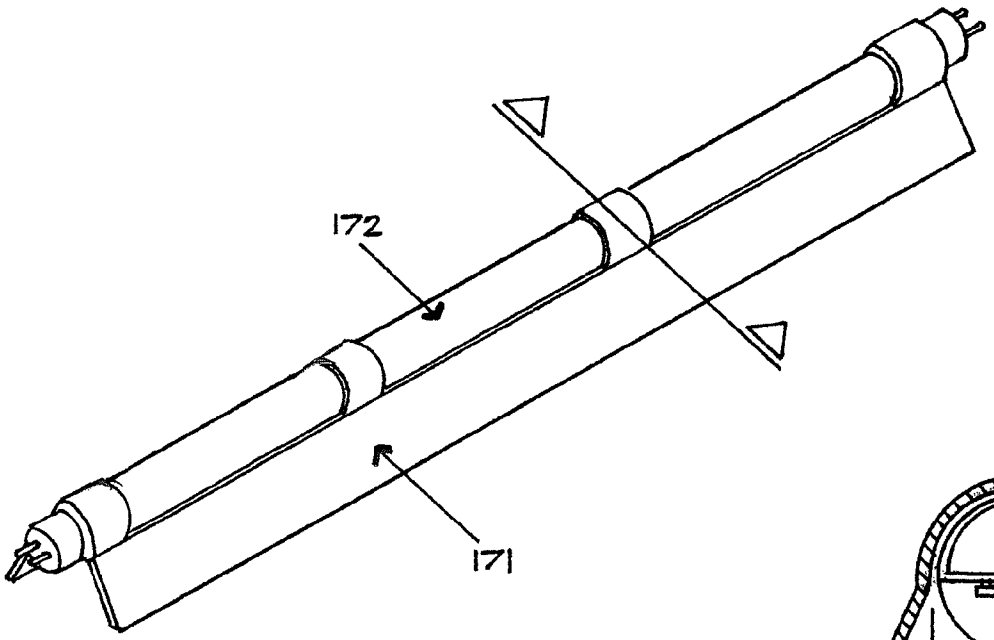
FIG. 20
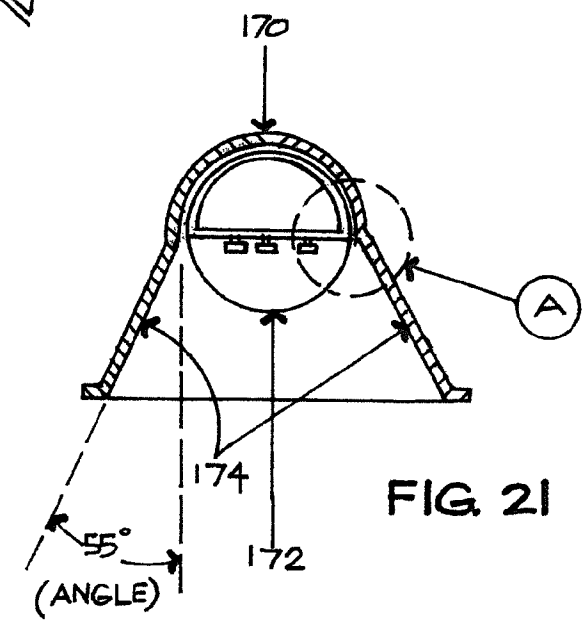
FIG. 21
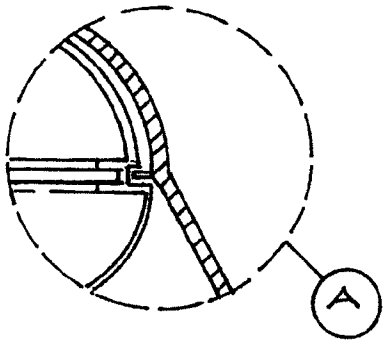

MODULAR LIGHTING ASSEMBLY

CROSS REFERENCE TO RELATED APPLICATIONS

This application claims the benefit of U.S. Provisional application Ser. No. 61/725,705 having a filing date of Nov. 13, 2012.

FIELD OF THE INVENTION

The present invention relates to a light emitting diode (LED) light tube assembly for multiple applications. An LED light assembly may contain an elongated shape light tube having end caps at both ends of the tube, one end cap comprised of a pair of extended prongs to receive AC power and the second end cap comprised of a pair of sockets to connect and provide AC power to a second LED light tube. Alternatively, it may be DC power that is provided in a known manner.

An LED light assembly may contain both a light emitting diode (LED) light tube and a special socket system within a new fixture that eliminates all or substantially all of the typically associated wiring in a known troffer system.

An LED light tube assembly may contain an attachable light deflector or reflector for predetermined distribution of the light emanating from the LED light assembly. The light deflector may or may not be adjustable to tailor the intensity of the light directed below the assembly.

BACKGROUND OF THE INVENTION

Energy conversation continues to be a national priority of the United States as well as the rest of the world.

The number one light fixture used within commercial construction is a fluorescent light tube troffer fixture. There are thousands of these fluorescent light tube fixtures within schools, homes, retails stores, hospitals, and offices for example. Although fluorescent light tubes are recognized for numerous advantages relative to incandescent light sources, these tubes still leave room for improvement for various reasons. For example, care must be taken to dispose of the fluorescent light tubes to avoid releasing the mercury within the tube into the environment. other solid state lighting. In comparison, conventional LED lighting tubes provided lower energy consumption and markedly longer life. Further, LED technology was more environmentally friendly given a reduction of waste, and more importantly, given the absence of mercury in the LED tube.

The typical LED replacement light tube was invented to replace a fluorescent light tube within an existing fluorescent fixture. The design and operation of these LED replacement light tube is based on retrofitting the LED light tube to operate from AC current. Another common aspect of the LED light tube for replacing of fluorescent light tubes is they consist of a transparent tube, with LEDs mounted onto a circuit board inside the tube and operated by AC power. The assembly of a typical LED light tube incorporates both the LEDs and circuitry within one tube. Located at each end of the LED replacement light tube are end caps, each end cap is comprised of a pair of extended prongs and means to receive AC power from sockets located at both ends of the fluorescent light tube fixture.

Architects have always used lighting as a means to enhance the architectural features of their buildings. One area of design architects have made it a practice to incorporate within their design is indirect lighting. Hospitals, churches, and offices are just a few examples of buildings that feature some form of indirect lighting. The single tube fluorescent fixture installed end to end is one way architects provide indirect lighting. When using an LED light tube as a light source for indirect lighting, a fixture containing sockets at both ends would be an improvement to operate one LED light tube. A normal project featuring indirect lighting could require 10 or more LED light tubes (installed within a fixture) and lined end to end. Using this type of LED light assembly would apparently be very costly. It is the primary objective of the present invention to overcome this costly type of light assembly. A better light assembly is needed for indirect lighting that would allow LED light tubes to be lined end to end without the required to two socket fixture.

Finding a more cost effective way to use LEDs within a light tube as a light source for indirectly lighting within a space or room is one of the objective of this present invention. Finding a socket assembly that can be used with LED light tubes and be incorporated within a strip fixture or troffer would be another objective of the present invention.

BRIEF DESCRIPTION OF THE DRAWINGS

FIG. 3 further illustrates an LED light assembly containing a pair of plugs for plugging within a socket and the means to receive AC power from an electrical outlet in accordance with the present invention.

FIGS. 20 and 21 illustrate a LED light assembly and an attachable reflector to help direct the light source in accordance with the present invention.

SUMMARY OF THE INVENTION

Figure 1:
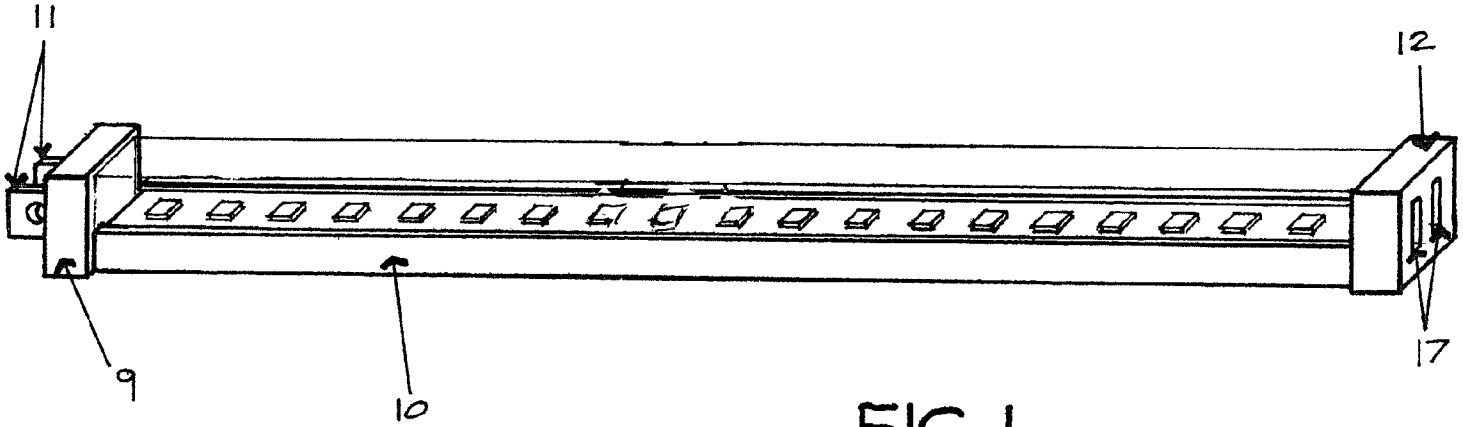
FIG. 1 illustrates a perspective view of an exemplary embodiment of a LED light assembly having one end cap containing a pair of square plugs as the means to receive AC or DC power and a second end cap functioning as a socket to receive a second LED light assembly in accordance with the present invention.

Accordingly, one object of the present invention is to overcome the drawbacks of the prior art of using several two socket fixtures, lined end to end as the means of providing indirect lighting within a space or room. A second objective of the present invention is a socket assembly that will allow LED light tubes to be connected end to end, or used within a troffer/strip fixture replacing the traditional socket and the extensive wiring normally required at both end of a troffer/fixture. A third objective of the present invention is an attachable reflector that will help direct the light from the LED light tube in a predetermine direction.

A first embodiment of the present invention contains an LED light tube assembly that is similar in size of a fluorescent light tube but featuring a square shape. An LED light tube assembly comprises two end caps, one of each being located at a respective end of the light tube assembly, one end cap to receive power from an AC socket and the second end cap to provide AC power to a connecting second LED light tube assembly. An LED light tube may contain: an AC to DC convertor and means to power one or more LEDs; a circuit board that allows the mounting of one or more LEDs; a connector that connects the circuit board to AC socket as the means to receive AC power; and a hot line and a neutral line that directs AC power to the opposite end of the LED light tube, as the means to power a second LED light tube assembly.

A second embodiment of the present invention is similar to the first embodiment but exhibits a round design instead of a square shape. The second embodiment is comprised with the same components of that of the first embodiment. A third embodiment of an LED light tube assembly contains no transparent cover eliminating the heat built up within the tube and will thereby provide longer life for both the LEDs and the circuitry. A LED light assembly that powers one or more LEDs within a housing having a tubeless and bulb-free sub-housing in contrast to and as distinguished by the tubular bulbs typically used in fluorescent tube technology for example; a first array containing one or more light emitting diodes (LEDs) contained within the bulb-free sub-housing and powered by DC energy. The present invention as exemplified in the first, second and third embodiments contains end caps that allow the connection of several LED light tubes/assemblies, each having special connectors that allow the LED light tube/assemblies to be connected from one end of one tube to another end of an adjoining tube.

The present invention is comprised of a special socket system that facilitates electronic communication and physical connection between two or more LED light tubes. The first socket embodiment of the special socket system contains a single socket for connecting two LED light tubes end to end. Another socket embodiment is a double socket system, where one socket receives one end of a LED light tube and receives AC power while the second socket connects and provides AC power to a second LED light tube. A third socket embodiment contains a connecting socket that provides physical connection and AC power to two, three, or more LED light tubes connected end to end to each other. A special socket may also be included that facilitates the orthogonal and parallel placement of LED light tubes even though they electronically communicate and are in physical connection with each other.

A fourth embodiment of the present invention is a LED light tube assembly comprised with a dimming system that allows the LEDs to operate at different levels of brightness.

In yet another aspect of the present invention, a lighting unit or assembly may contain any one of the embodiments of the present invention containing a light deflector or reflector for predetermined distribution of the light emanating from the modular LED light assemblies. Each reflector has a refractive angle designed for focusing and collecting the light of each LED light source in order to prevent a diffusion of the light or an insufficient brightness, and also avoid a formation of light spots by the light of the LED light source. The light deflector may or may not be adjustable to tailor the intensity of the light directed below the assembly.

Stated another way, the present invention may be characterized as a light assembly containing: a first component containing a first end and a second end and at least one light emitting diode, the first component communicating with an electronic source; and a second component containing a third end and a fourth end and at least one light emitting diode; a first male connector at the first end of the first component for connecting to the electronic source; a first female connector at the second end of the first component; and a second male connector at the third end of the second component, for electronically communicating with the first female connector, wherein the second component physically and electronically communicates with the first component. One or more additional components may be similarly added to the first and second components in physical and electronic communication therewith.

Other benefits of the present invention will become apparent based on the following description.

DETAILED DESCRIPTION OF THE PREFERRED EMBODIMENT(S)

The technical characteristics of the present invention will become apparent with the detailed description of the preferred embodiment and the illustration of the related drawings as follows:

FIG. 1 illustrates the first embodiment of the present invention is a LED light assembly 8 containing a housing 10 that is similar sized and square shape of a fluorescent light tube and comprised of two end caps. One end or end cap 9 contains a male connector pair of extending prongs 11 as the means to receive AC or DC power. A second end or end cap 12 located opposite of end 9, contains a female connector or two receptacles or sockets 12 as the means to connect and provide AC power to a second LED light tube.

Figure 2:
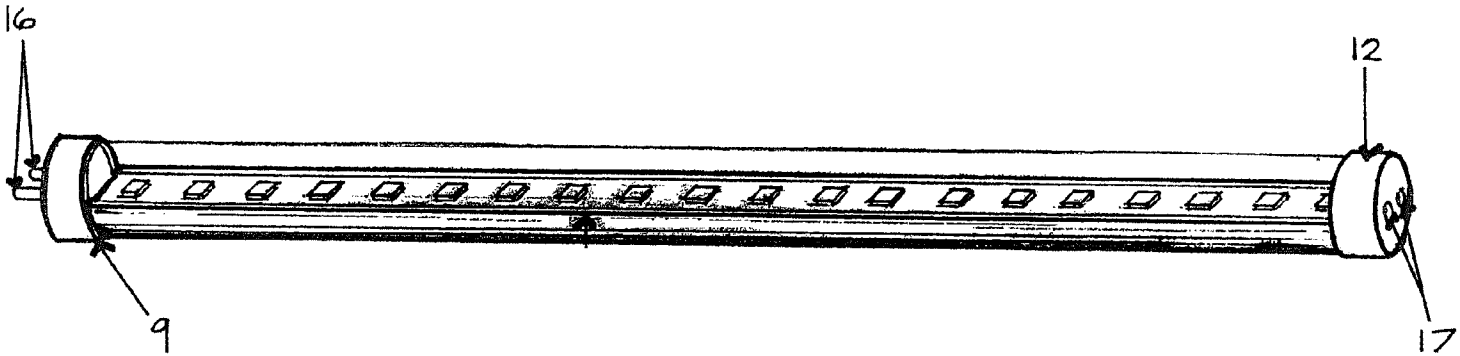
FIG. 2 illustrates a perspective view of an embodiment of a LED light tube assembly containing one end cap that contains a pair of prongs as the means to receive AC or DC power and a second end cap to function as a socket to receive a second LED light tube in accordance with the present invention.

FIG. 2 illustrates a second embodiment of the present invention. An LED light assembly contains a housing that is similar size and shape of a fluorescent light tube. Again one end cap 9 contains a pair of extending prongs 16 as the means to receive AC or DC power. A second end cap 12 located at an opposite end of the light assembly contains two receptacles or sockets 17 for electronic communication with an adjoining LED tube/assembly.

Figure 3:
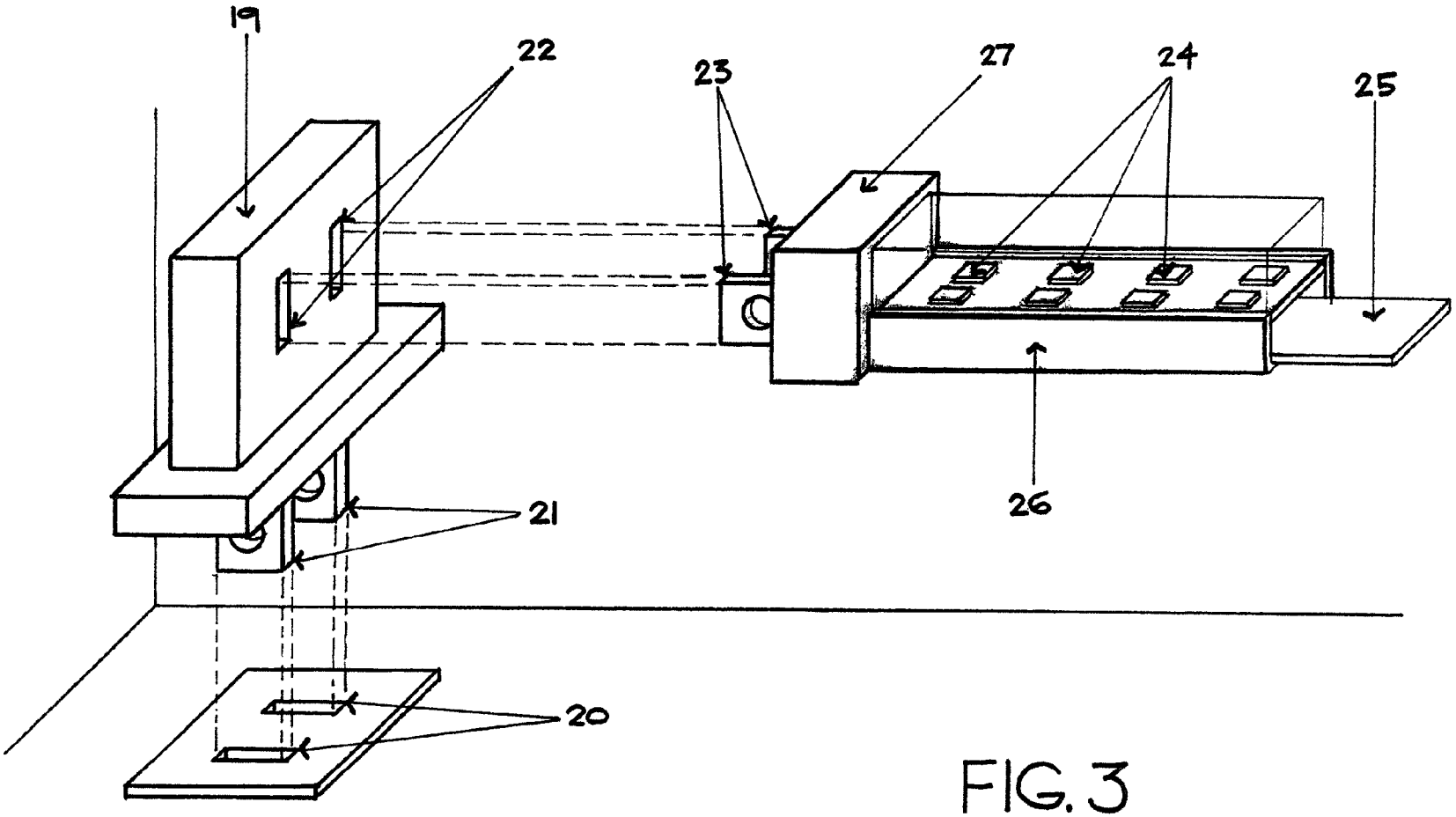
FIG. 3 illustrates a perspective view of a socket containing a pair of plugs as the means to connect to an AC outlet.

FIG. 3 illustrates an AC socket 19 containing a male connector or a pair of extending connectors 21 as the means to plug into an AC power source 20. FIG. 3 illustrates one end of an LED light assembly 26 containing an end cap 27 having a pair of extending connectors 23 that facilitates the electronic communication of the LED light assembly with an AC socket, by plugging the assembly therein. Known circuitry 25 is incorporated within the housing 10 of the LED light tube assembly to convert AC power to DC power to operate one or more LEDs 24.

Figure 4:
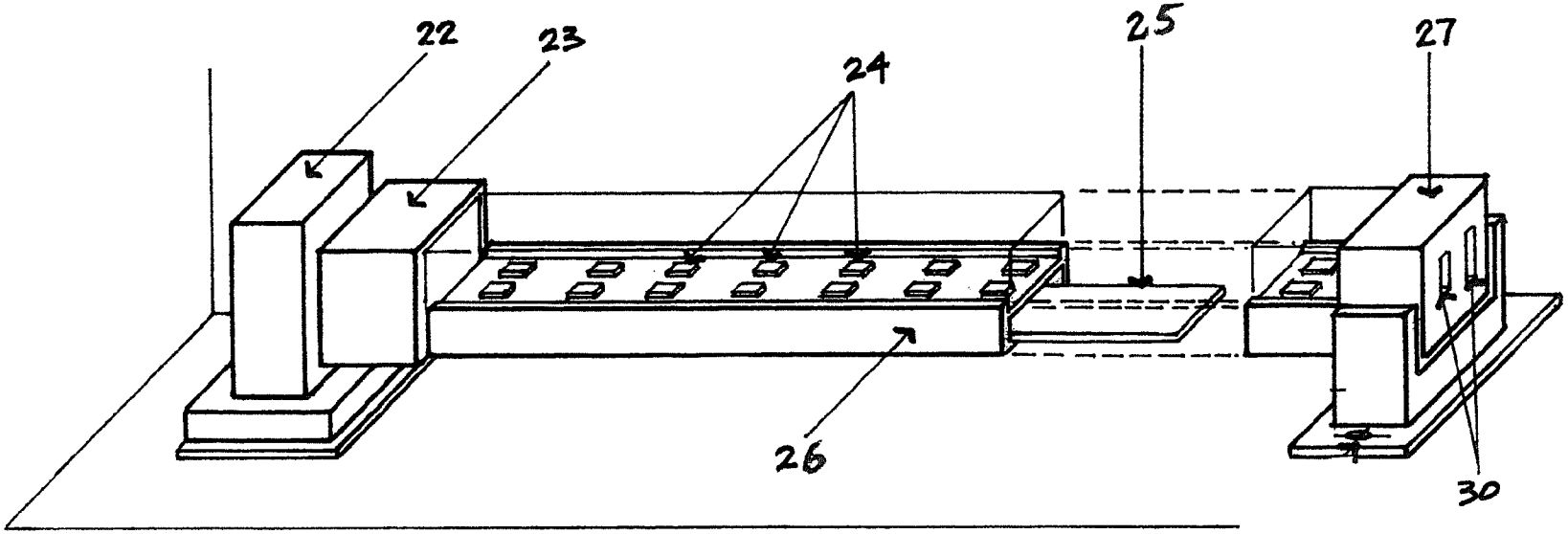
FIG. 4 illustrates a perspective view of an LED light assembly containing a pair of end caps and a plug, and an LED light assembly plugged into an AC outlet in accordance with the present invention.

FIG. 4 illustrates yet another embodiment of an LED light tube assembly plugged into an AC socket holder 22 for receiving AC power. An LED light tube assembly contains a similar elongated shape and size as that of a fluorescent light tube. An LED light assembly 25 contains an AC/DC convertor 26 to convert the AC power to DC power, and the means to operate one or more LEDs 24. The LED light tube contains a first end cap 23 and a second end cap 27, each respectively installed at opposite ends of the tube/envelope. The first end cap 23 contains connector pins extending from the end cap 23, enabling the LED light assembly to be installed/plugged into the AC socket holder. The second end cap 27 is contains a pair of receptacles or sockets 30 that facilitate the physical connection and electronic communication of a second LED light tube with the first tube 25.

Figure 5:
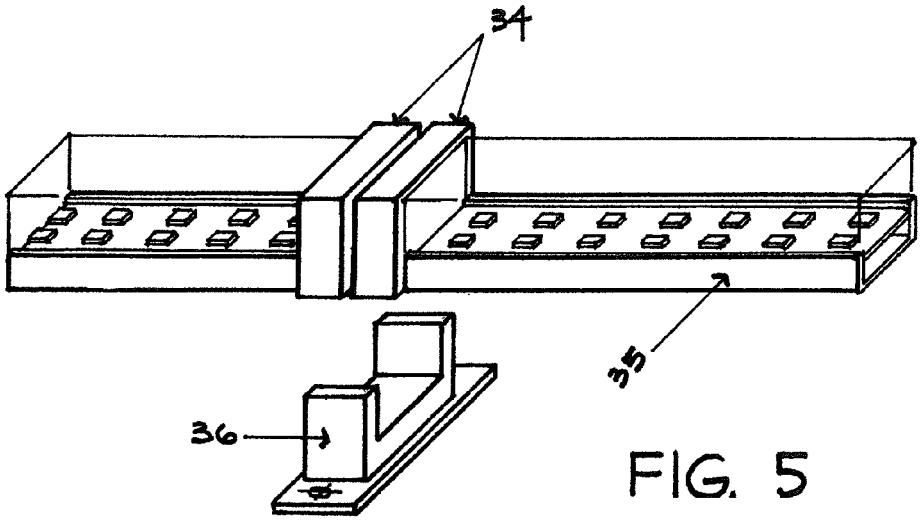
FIG. 5 illustrate a perspective view of the connection of two LED light assemblies, connected end to end and locked together by a special bracket in accordance with the present invention.

FIG. 5 illustrates two LED light tubes/assemblies 35 connected together by two end caps 34 converting a 4 foot light tube to an 8 foot light tube assembly. A support bracket or support member 36 may be positioned directly below the junction 34*a* of the two LED light tubes as the means to support and lock the two LED light tubes together as one.

Figure 6:
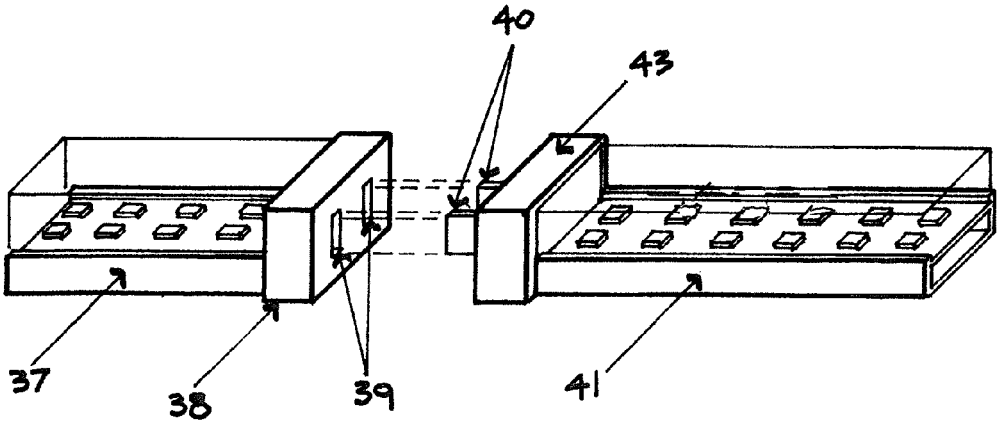
FIG. 6 illustrates a perspective view of two LED light assembly being connected together end to end in accordance with the present invention.
Figure 7:
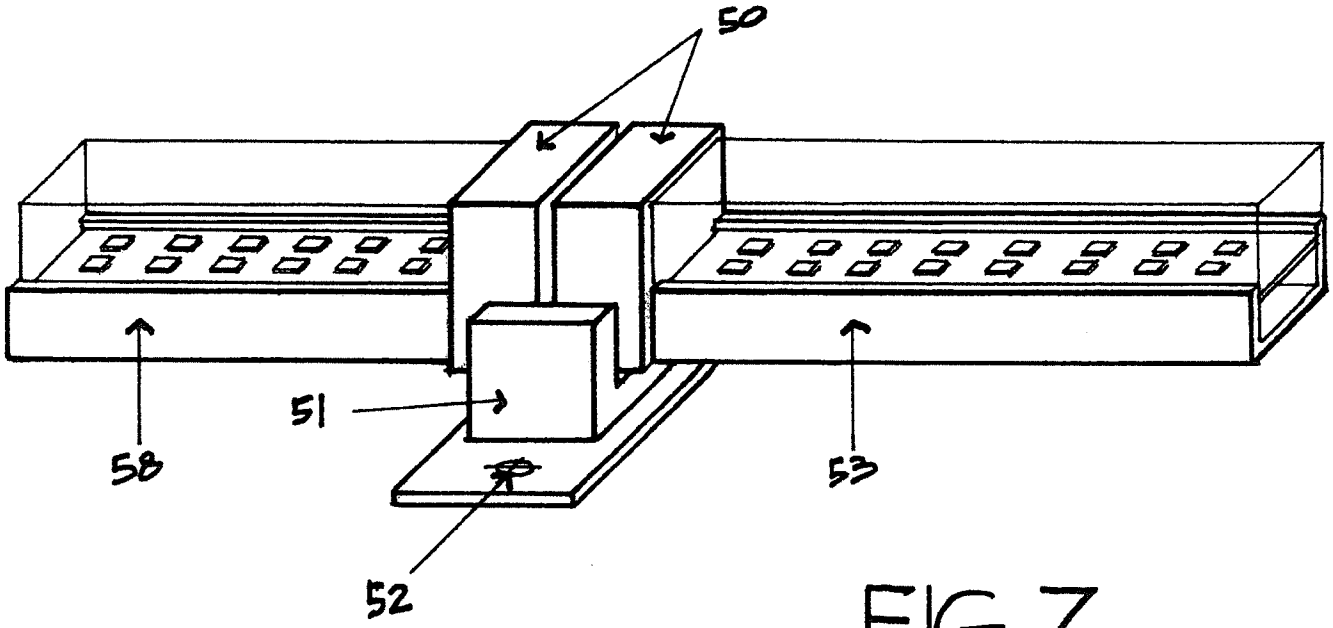
FIG. 7 illustrates a perspective view of two LED light assembly connected end to end and locked together by a special bracket in accordance with present invention.

FIG. 6 shows an end cap 38 of the first LED light assembly 37 having a female connector or female receptacles 39 as the means to connect and provide AC power to a second LED light tube 41 containing an end cap 43 having a male connector or pair of connector pins 40 extending from the end cap 43. FIG. 7 shows two LED light tubes 53/58 connected by two ends 50, and held or removably fixed together by a support bracket 51 having a platform 52 for stabilization of the junction point.

Figure 9:
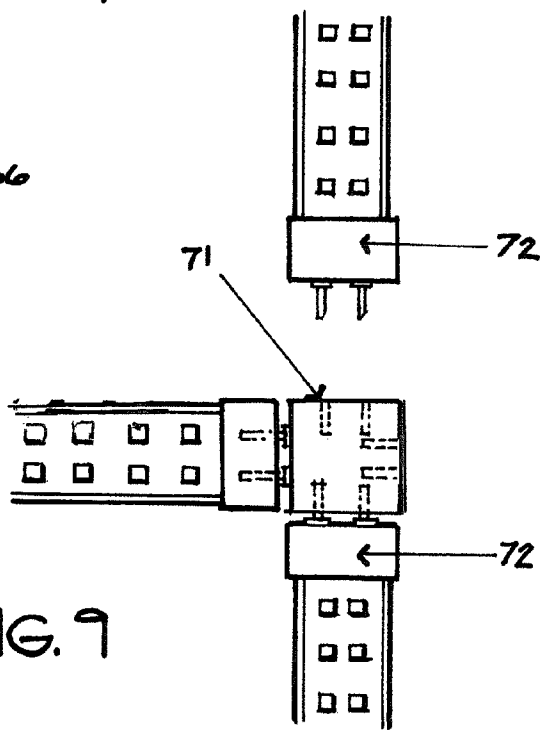
FIG. 9 illustrates a plan view of the same three LED light assemblies connected together by a special connector that allows each LED light assembly to be configured or oriented in a different direction as compared to the other LED light assemblies, in accordance with the present invention.
Figure 8:
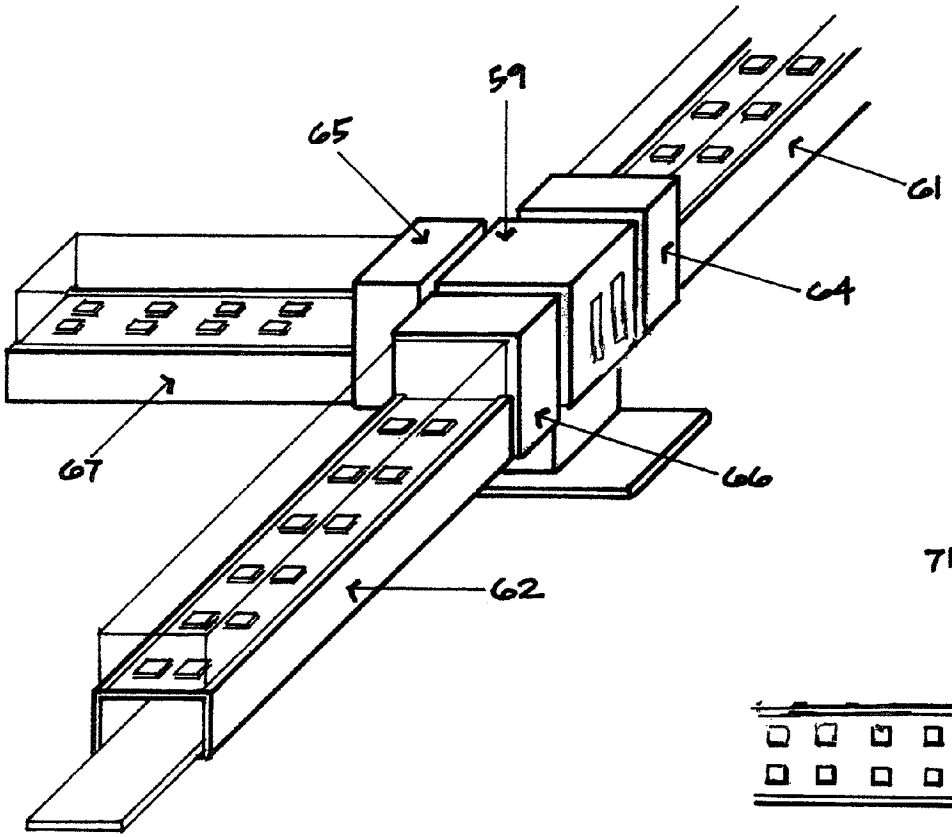
FIG. 8 illustrates a perspective view of three LED light assembly connected together by a special connector that allows each LED light assembly to be directed in three different directions and receive AC power in accordance with the present invention.

FIG. 8 illustrates a perspective view of a multiple receptacle socket 59 connects to end caps 64/65/66 of three LED light assembly 61/62/67 thereby connecting and providing AC power to one to three LED light tubes. As shown in FIG. 9, a four-sided socket 59 provides the means of changing the direction or orientation of various LED light tubes of the overall assembly. FIG. 9 illustrates a plan view of the special four sided socket 71 being connected by end caps 72 to three LED light tubes.

Figure 10:
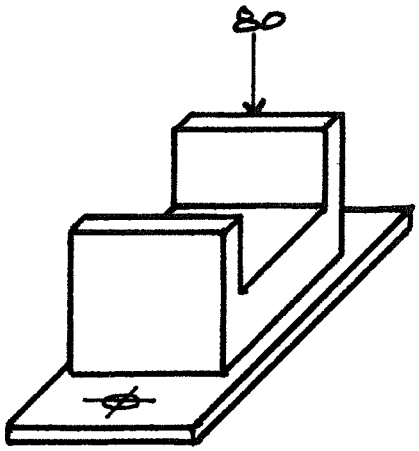
FIG. 10 illustrates a perspective view of a special bracket that locks together the two LED light assemblies and facilitates the mounting of the light assembly to a base surface in accordance with the present invention.
Figure 11:
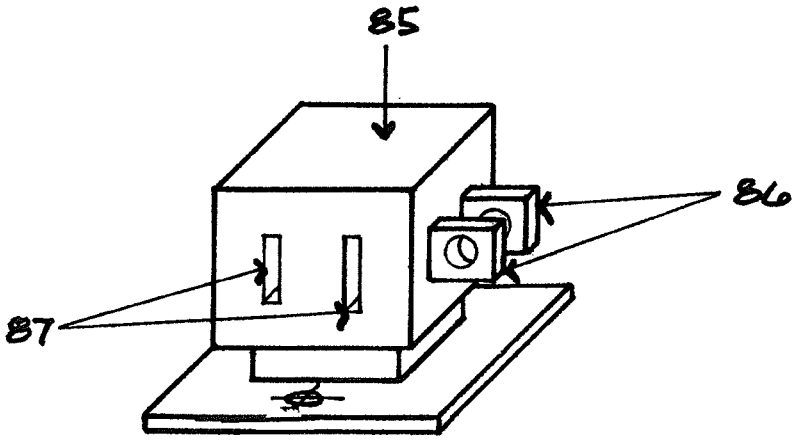
FIG. 11 illustrates a perspective view of an end connection or junction that allows the connection of other LED light assembly to be connected and directed in another direction in accordance with the present invention.

FIG. 10 shows an embodiment of a supporting bracket or support member 80 providing the means to connect and lock LED light tubes together. FIG. 11 shows an embodiment of a supporting bracket and/or socket 85 comprised of a pair of extending prongs 86 for connecting into the end of LED light tube assembly as the means to receive AC power. The AC power may be directed and connected to one or more additional LED light tube assemblies by receptacles/sockets 87 located on each side of the support bracket 85.

Figure 12:
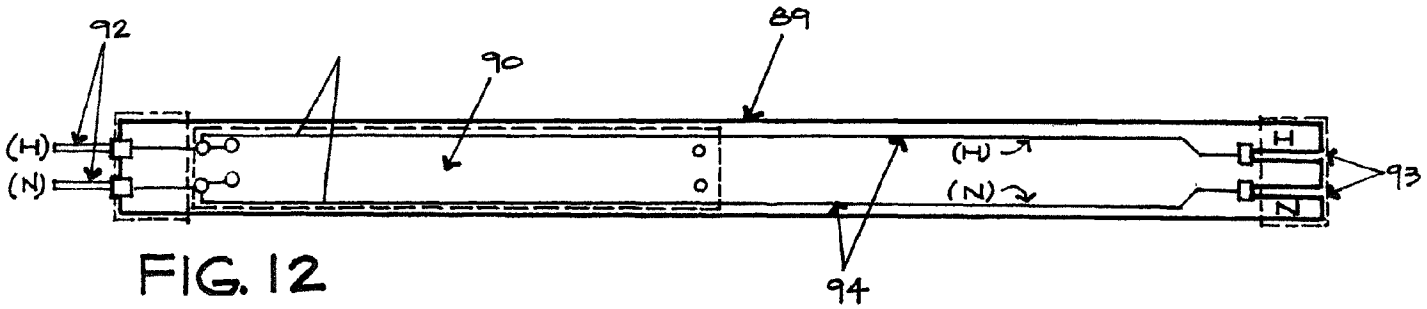
FIG. 12 illustrates a plan view of a circuit board showing the AC/DC convertor and both end caps in accordance with the present.
Figure 13:
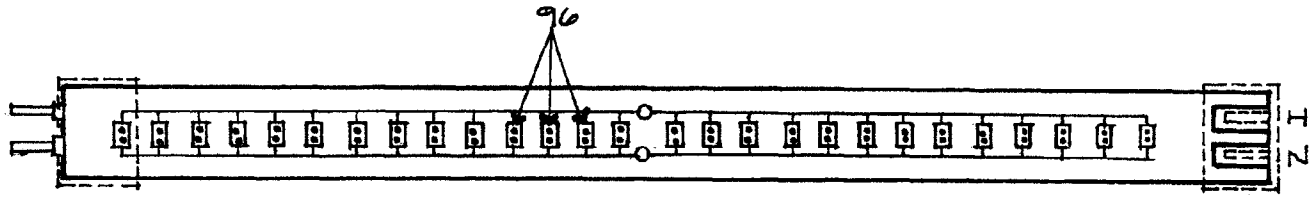
FIG. 13 illustrates a plan view of the top side of the circuit board showing the LEDs and associated circuitry, in accordance with the present invention.

FIG. 12 and FIG. 13 illustrate the bottom and top side of the present invention. A circuit board 89 contains a pair of extending connectors 92 at a first end and a pair of receptacles 93 at a second end. The circuit hoard receives AC power from the pair of extending connectors 92 and converts that AC power to DC power to operate one or more LEDs 96. The circuit board 89 contains of two lines 94 (one line hot, the other neutral) running end to end, each substantially extending the length of the board 89 and running in spaced relationship to each other. A pair of prongs 92 function as an AC power connection. The AC power is directed to an AC/DC convertor 90 to operate one or more LEDs. The AC power is then directed to the opposite end to a pair of receptacles 93. FIG. 13 illustrates one or more LEDs 96 mounted onto the top side of a circuit board.

Figure 14:
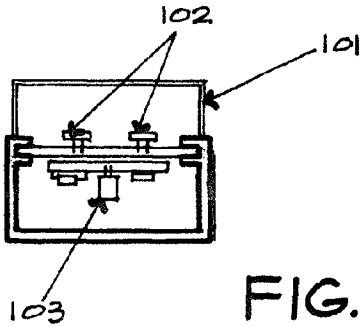
FIG. 14 illustrates a cross section of an LED light assembly containing an AC to DC convertor and LEDs within a transparent tube/enclosure in accordance with the present invention.
Figure 15:
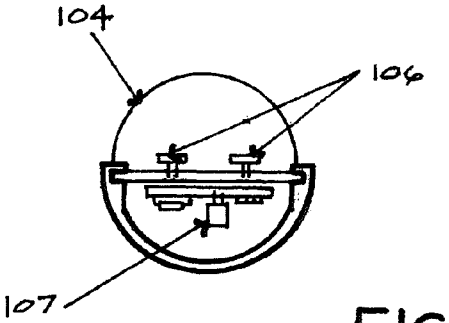
FIG. 15 illustrates a cross section of a second embodiment of a LED light tube containing an AC to DC convertor and LEDs within a transparent tube/enclosure in accordance with the present invention.

FIG. 14 illustrates a cross section through a square shape LED light tube assembly 101 while FIG. 15 is a cross section through a round shape tube 104. Both assemblies 101 and 104 contain an AC/DC converter 103/107 and a grouping of LEDs 102/106.

Figure 16:
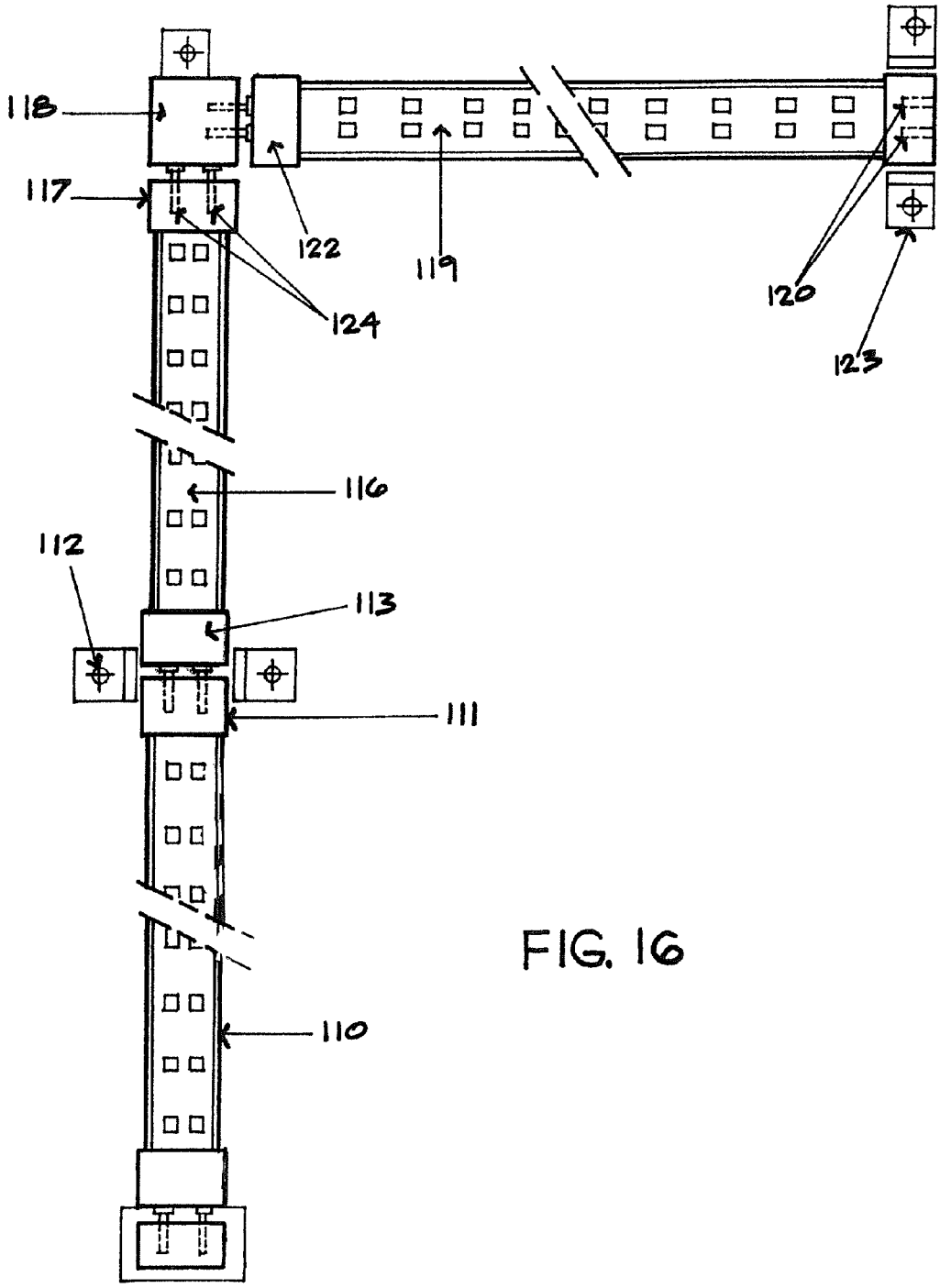
FIG. 16 illustrates a plan view of several LED light assemblies and how they can be assembled in accordance with the present invention.

FIG. 16 illustrates three LED light tube 110/116/121 connected by end caps 111/113/117/122 and locked in place by a support bracket 112. One support bracket 112 may assist in connecting two LED light tubes 110/116 end to end. A third LED light 121 connected by a corner support socket and bracket 118 containing one pair of extending prongs 124 to receive AC power and three sides, each of the three sides containing receptacles (not shown) as the means for connecting and receiving AC power to additional LED light tubes.

As shown in FIG. 16, the present invention may be characterized as an LED light assembly containing a two endcaps 111/113 that facilitate end to end physical and electronic connection of multiple light assemblies/tubes, perhaps connected and locked in place by a support bracket 112. The present LED light tube assemblies therefore function as a cost-effective solution for indirect lighting.

Figure 17:
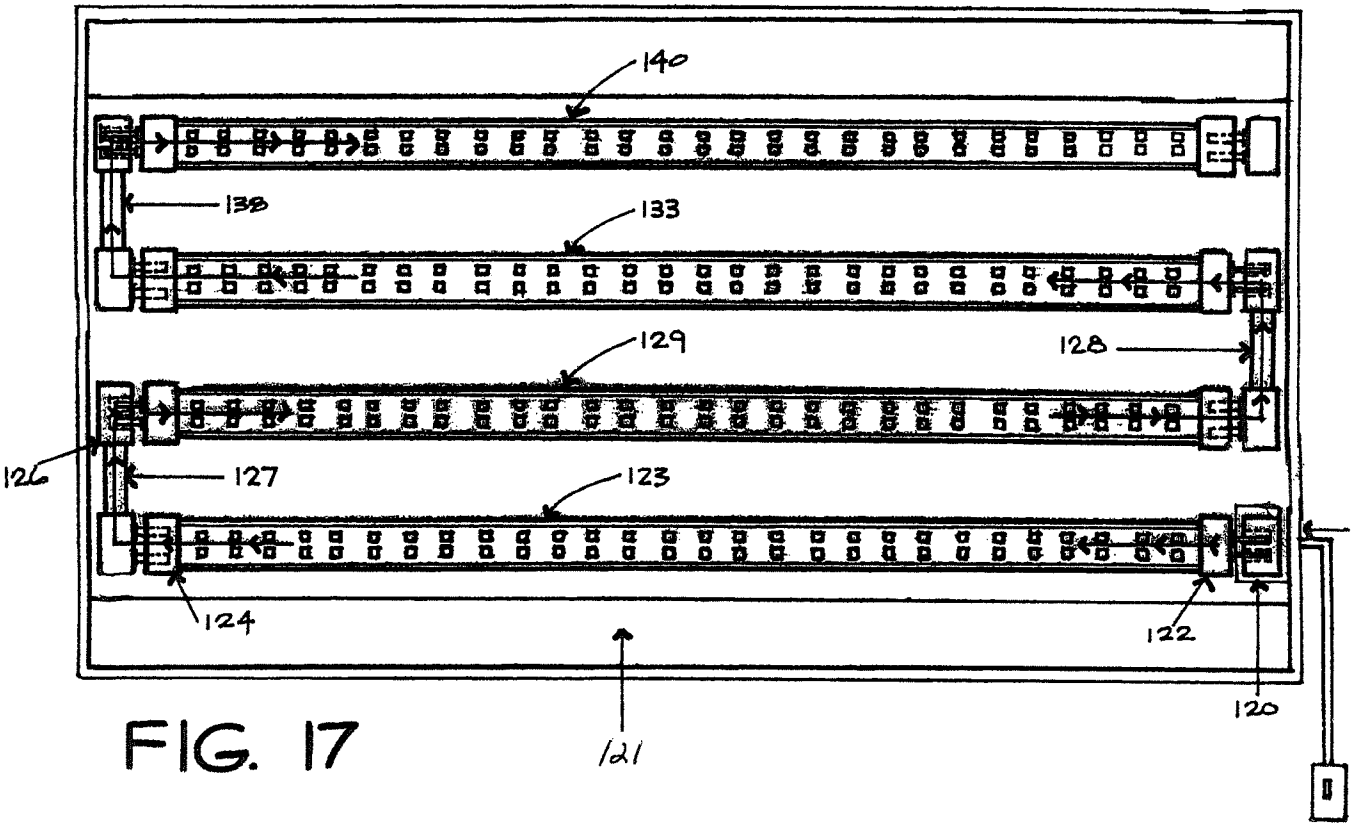
FIG. 17 illustrates a plan view of a socket assembly that allows connection of four LED light tubes within a Troffer/fixture in accordance with the present invention.
Figure 18:
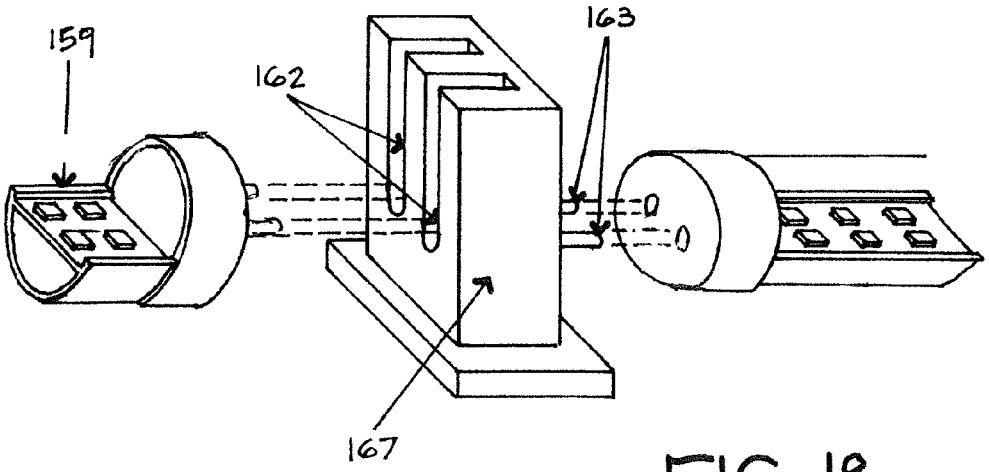
FIG. 18 illustrates a perspective view of a socket assembly that connects two LED light tubes together, end to end in accordance with the present invention.
Figure 22:
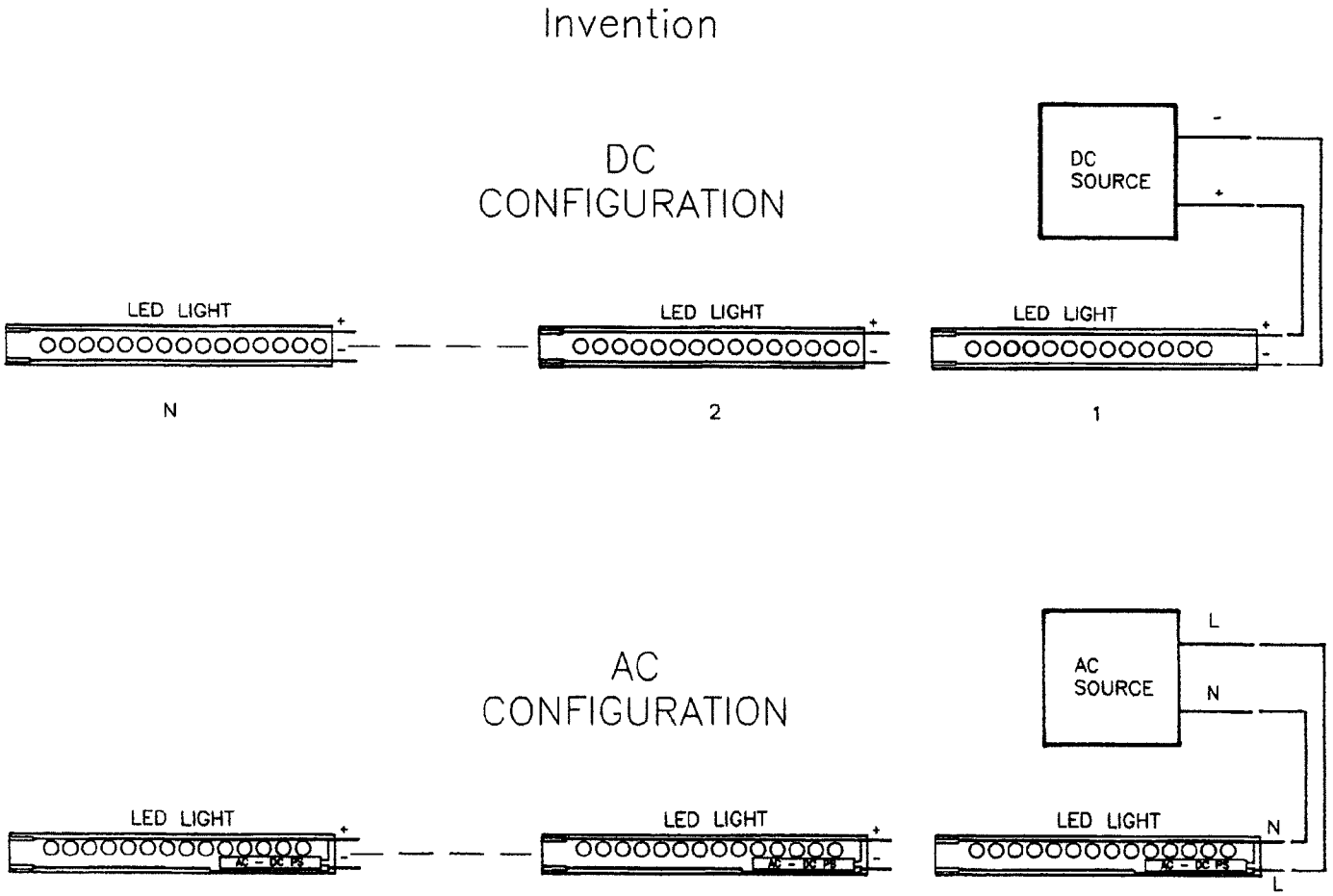
FIG. 22 illustrates a LED light tube assembly and comprised of a DC configuration and/or an AC configuration in accordance with the present invention.

It will be appreciated that the LED light assembly referred to above is configured in a known way to accommodate LED light tubes within a troffer/strip fixture. A traditional troffer or strip fixture requires sockets at both ends of the troffer, and each socket requires wiring to direct the AC power source. FIG. 17 illustrates a plan view of a four-tube troffer 119 being powered by a power socket 120 (as shown in FIGS. 3 and 4), three double sockets 127/128/138 (as shown in FIG. 18) and one non-conducting support socket 142 (as shown in FIG. 10) at the terminal end of the fourth LED light tube 140. FIG. 17 illustrates a troffer assembly that eliminates all or substantially all wiring as is typically required in state-of-the-art troffers and fluorescent light assemblies or replacement LED troffer assemblies. FIG. 17 also illustrates how the AC power may travel through the four LED light tubes: the first tube 123 directs AC power through the tube to the first double socket system 127 containing one pair of extending connectors 124. The AC power received by the connectors 124 is then directed to an adjoining socket 126 that connects to a pair of extending prongs from a second LED light tube 129. The AC power is then directed through the second LED light tube 129 to the opposite end cap comprised of a pair of receptacles. The AC power is directed through the second tube 129 to a second double socket system 128 that may be similar or identical to the first double socket system 127. The second double socket system 128 then directs the AC power to a third LED light tube 133 to a third double socket system 138 that connects and powers the fourth and final LED light tube 140. Each LED light tube receives AC power that is converted by an AC to DC converter to operate one or more LEDs and at the same time direct AC power to a double socket system.

A two-sided socket or conductive junction 167 is exemplified in FIG. 18. One side of the socket contains a male connector or pair of extending prongs 163 that plug into an LED light tube to receive AC power. On the opposite side of the two sided socket, are female receptacles or a female connector 162 that facilitate the connection of a second LED light tube 159. The two sided socket facilitates an end-to-to end connection of two or more LED light tubes whereby AC power is electronically communicated to each LED light tube/assembly without any additional wiring.

Figure 19:
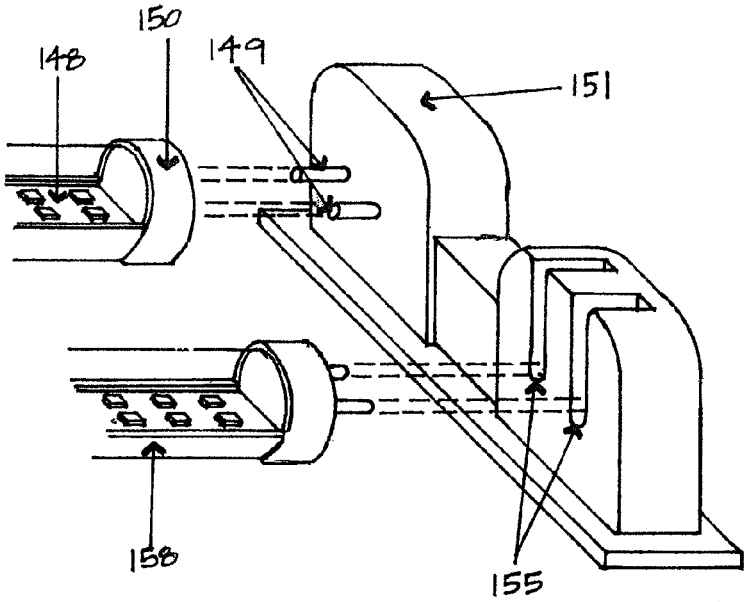
FIG. 19 illustrates a perspective view of a double socket assembly that connects two LED light tubes together for use with the present invention.

FIG. 19 illustrates a double socket 151 comprised of a socket system that incorporates two extending connectors 149 for connecting two LED light tubes 148/159 as shown in FIG. 17. The first connector of the double socket system is comprised of a pair of extending prongs 149 for plugging or connecting into the end of a LED light tube 148 comprised of a pair of receptacles 150. The second connector 155 of the double socket system is comprised of a socket 155 that allows the connecting a second LED light tube 158. The double socket system receives AC power from an attaching LED light tube, directs the AC power to an adjoining socket to power a connecting second LED light tube.

The term "bulb-free" as used herein is meant to convey that the sub-housing is not encased with glass or otherwise formed as a bulb or a portion of a bulb. The term "bulb-free" is not meant to convey that no bulbs are used within the sub-housing (light emitting diodes for example), but that the elongated housing is itself not a bulb or a bulb portion, nor does it contain a bulb or bulb portion covering the whole tube containing the LED circuitry and LEDs (as with a fluorescent bulb for example).

FIG. 20 illustrates an attachable deflector 171, if used, either to mitigate or prevent light from being directed "behind" the LED lighting source 172, and/or to direct the light outwardly and downwardly from the overall light fixture. Reflectors 171 or deflectors are fixed along the length of the LED light assembly 172 and extend from the first and second longitudinal sides, thereby providing a focused direction of the light generated by the LED light assembly. The reflectors 174 in FIG. 21 are optional but may be used to enhance the efficacy of the light presented. The reflectors may be removably fixed to the LED light assembly, and may or may not be angularly adjustable once attached to the base unit. For example, the reflectors may be adjusted to increase or decrease the angle defined between the first longitudinal side and the reflective surface of the reflector.

As shown in FIGS. 1-2, for example, the periphery of the housings 10 is generally depicted as being half-rectangular. It will be appreciated that the peripheral geometry of the housing may be formed to accommodate the spatial requirements of the circuitry, and may therefore be comprised of other shape and size to fit in the requisite components. Nevertheless, the rectangular geometry of the housing is preferably maintained at least around the ends to facilitate a ready receipt of the connectors within the female sockets.

Various other optional features such as dimmer switches or multi-colored LEDs may be provided.

In the present invention, the circuitry may be provided as known in the art. U.S. Pat. No. 7,049,761, herein incorporated by reference in its entirety, exemplifies certain circuitry that may be useful in the present invention. U.S. Pat. No. 6,936,968, herein incorporated by reference in its entirety, exemplifies but does not limit the various circuitries that could be employed to accommodate a one-endcap system.

The LED light tube assemblies of the present invention may be electronically configured as shown in FIG. 1 and FIG. 2, for example. Alternatively, power may be supplied to these light assemblies as known in the art. For example, U.S. Pat. Nos. 7,815,338, 7,712,918, 7,510,299, and 7,049,761, herein incorporated by reference in their entireties, exemplify various electronic configurations that may be employed in the contexts of the present invention.

The invention may therefore described as:

A modular light assembly containing—a first LED subassembly or component in direct electronic communication with a second LED subassembly or component, whereby the first and second. LED subassemblies are powered by the same AC input to either the first or second LED subassembly, and the first and second LED subassemblies are connected end-to-end with each other. Additional LED subassemblies may be physically connected and in electronic communication with the first and second LED subassemblies as desired, in the same end-to-end configuration. The first and second LED subassemblies, and any other subassemblies, may be in orthogonal or parallel relationship to each other, as determined by design criteria.

It will be understood that the foregoing descriptions of embodiments of the present invention are for illustrative purposes only and should not be construed as limiting the scope of the invention. As such, the various structural and operational features herein disclosed are susceptible to a number of modifications commensurate with the abilities of one of ordinary skill in the art, none of which departs from the various permutations described herein, or as shown in the drawings, or as included in the appended claims.

What is claimed is:

1. A light assembly comprising:

an elongated first component containing a first end and a second end and at least one light emitting diode, said first component communicating with an electronic source;

an elongated second component containing a third end and a fourth end and at least one light emitting diode, said first and second components linearly connected at a wireless conductive junction, wherein said second component electronically communicates with said first component; and a support bracket fixed at said junction for supporting said first and second components.

2. The light assembly of claim 1 further comprising:

a first male connector at said first end of said first component for connecting to said electronic source;

a first female connector at said second end of said first component; and a second male connector at said third end of said second component, for electronically communicating with said first female connector.

3. The light assembly of claim 1 further comprising:

an elongated third component containing a first end and a second end and at least one light emitting diode, and in electrical communication with either said first or second component.

4. The light assembly of claim 3 further comprising:

a second conductive junction defined by a multiple receptacle socket containing at least two connectors for mating said first component or said second component, and said third component, thereto.

5. The light assembly of claim 3 wherein at least two components of said first, second, and third components are orthogonally positioned to each other.

6. A light assembly comprising:

a first component containing a first end and a second end and at least one light emitting diode, said first component communicating with an electronic source;

a second component containing a third end and a fourth end and at least one light emitting diode;

a first male connector at said first end of said first component for connecting to said electronic source;

a first female connector at said second end of said first component;

a second male connector at said third end of said second component, for electronically communicating with said first female connector; and a wireless conductive junction defined by a multiple receptacle socket having at least two pairs of connectors, said multiple receptacle socket modularly separable from said first and second component, wherein said second component electronically communicates with said first component at said wireless conductive junction.

7. The light assembly of claim 6 further comprising a third component containing at least one light emitting diode, said third component in physical and electronic communication with at least one of said first and second components.

8. A light assembly comprising:

an elongated first component containing a first end and a second end and at least one light emitting diode, said first component communicating with an electronic source;

an elongated second component containing a third end and a fourth end and at least one light emitting diode, said first and second components linearly connected at a junction, wherein said second component electronically communicates with said first component;

an elongated third component containing a first end and a second end and at least one light emitting diode, and in electrical communication with either said first or second component;

a second conductive junction defined by a multiple receptacle socket containing at least two connectors for mating said first component or said second component, and said third component, thereto; and a support bracket fixed at said junction for supporting said first and second components.

9. The light assembly of claim 8 wherein said first and second components are linearly positioned to each other, and said third component is non-linearly positioned to said first or second component.

10. The light assembly of claim 9 wherein said second conductive junction may contain four connectors.

11. The light assembly of claim 8 wherein said first component or said second component is orthogonally positioned to said third component.

12. The light assembly of claim 8 wherein said conductive junction contains a female connector and a male connector.

13. A light assembly comprising:

an elongated first component containing a first end and a second end and at least one light emitting diode, said first component communicating with an electronic source;

an elongated second component containing a third end and a fourth end and at least one light emitting diode, said first and second components linearly connected at a junction, wherein said second component electronically communicates with said first component;

an elongated third component containing a first end and a second end and at least one light emitting diode, and in electrical communication with either said first or second component, wherein at least two components of said first, second, and third components are orthogonally positioned to each other; and a support bracket fixed at said junction for supporting said first and second components.

* * * * *